US007441372B2

(12) United States Patent
Bortoluzzi

(10) Patent No.: US 7,441,372 B2
(45) Date of Patent: Oct. 28, 2008

(54) BALANCING DEVICE FOR A SUSPENDED ELEMENT

(75) Inventor: Guido Bortoluzzi, Belluno (IT)

(73) Assignee: Bortoluzzi Mobili S.r.l., Belluno (IT)

( * ) Notice: Subject to any disclaimer, the term of this patent is extended or adjusted under 35 U.S.C. 154(b) by 668 days.

(21) Appl. No.: 10/508,845

(22) PCT Filed: Mar. 26, 2003

(86) PCT No.: PCT/EP03/03132

§ 371 (c)(1),
(2), (4) Date: Sep. 23, 2004

(87) PCT Pub. No.: WO03/080976

PCT Pub. Date: Oct. 2, 2003

(65) Prior Publication Data

US 2005/0115024 A1 Jun. 2, 2005

(30) Foreign Application Priority Data

Mar. 26, 2002 (IT) ..... BL2002A0005

(51) Int. Cl.
*E05F 11/00* (2006.01)

(52) U.S. Cl. ..... 49/200

(58) Field of Classification Search ..... 49/197, 49/199, 200

See application file for complete search history.

(56) References Cited

U.S. PATENT DOCUMENTS 1,922,370 A 8/1933 Blodgett et al.
2,116,329 A 5/1938 Sturman
6,134,835 A * 10/2000 Krupke et al. ..... 49/200

FOREIGN PATENT DOCUMENTS

WO 90 15216 12/1990

* cited by examiner

*Primary Examiner*—Jerry Redman
(74) *Attorney, Agent, or Firm*—Oblon, Spivak, McClelland, Maier & Neustadt, P.C.

(57) ABSTRACT

A balancing and equilibration device for suspended elements, e.g. doors, pieces of furniture, and windows that can be moved vertically, to allow their easy movement and balanced positioning at any point of their vertical travel. Supporting ropes are wound up to be translated in spiroid rims of a pair of opposing pulleys, the pulleys being integral with each other via a shaft rotatable on a bearing structure. The shaft is concentric to a helical spring that includes one end integral with the shaft and another end integral with a friction disc that can be blocked to its support to block the other end of the spring, whose opposite side is bound to turn with the shaft to increase or decrease its torsion reaction with changing movement of the pulleys, to assure balancing of the balanced translation of the element on a frame to be vertically covered or uncovered.

18 Claims, 6 Drawing Sheets

BALANCING DEVICE FOR A SUSPENDED ELEMENT

BACKGROUND OF THE INVENTION

1. Field of the Invention

The present invention relates to a balancing device for a suspended element, particularly for sash doors and windows to be vertically translated, comprising a shaft rotatably supported on a support, a pair of opposing pulleys attached to the shaft so as to be rotatable therewith, a pair of supporting ropes, one end of each of which being attached to the suspended element, and their respective other ends being attached to the pulleys, wherein each of the pulleys comprises a spiral groove onto which the respective ropes can be rolled for translating the suspended element.

The present innovation, in general, relates to a device for the balancing and the equilibration of the weight of suspended elements, particularly of doors of piece furniture and of sash windows and doors that can be vertically translated, to make their movement easier and their positioning in any point of their vertical travel balanced.

2. Description of the Related Art

The technique of providing pieces of furniture or fittings provided with sliding doors and sliding windows in particular to save space in houses and rooms of buildings, is well-known.

According to this known technique, in the pieces of furniture or fittings of the above mentioned type, the elements to be vertically translated are provided with pulleys and ropes linked to sash weights so as to balance the weight of the elements at issue, in order to allow their stable positioning in any point of their vertical travel.

However, it is clear that the presence of sash weights make the piece of furniture or the fittings heavier and increases their bulk because of the space required by the movement of the above mentioned weights.

A solution to these disadvantages has been proposed in the Italian patent application nr. PN. 92A000031 of the Applicant. The content thereof is incorporated herein by reference. Here, the sash weights have been replaced by traction springs that act on pulleys, each pulley having a side with a helical rim and a side with a spiral rim, on which the respective suspension ropes that link the element to the mentioned pulleys, wind up.

As a matter of fact, this prior art device reduces the weight of the element to be translated but it does not reduce its bulk, because the lateral thrusting spring needs space within the piece of furniture or window or door, thus even if the required space is reduced, it is not eliminated.

Moreover, maintaining the perfect and corresponding balancing of the thrusting springs is difficult to achieve with the passing of time, and causes sometimes unbalancings during the vertical travel of the moving element.

SUMMARY OF THE INVENTION

The problem underlying to the present invention is that of combining the advantages of the spring system that makes the element to be moved lighter than the element provided with the sash weight system, while eliminating the lateral bulk space and reducing anyway the total volume of the piece of furniture or window or door (suspended element).

The above problem has been resolved with the balancing device, as mentioned at the outset, wherein said shaft is linked to an end of elastic means whose opposite end is attached to a friction disc that is rotatably supported on said support and can be blocked against the support so as to allow the adjustment of the torsion load caused by the simultaneous rotation of the pulleys and the shaft.

In general, in order to achieve this object, it is provided to eliminate from the balancing device of the known type both the outdated sash weights and the lateral thrust springs, and to replace them with elastic means, particularly a single torsional spring to be placed on the linking shaft of the usual and known cone-shaped pulleys for the suspended element.

In the following, the terms suspended element, door, window, etc. refer to the same type of element, and can be replaced by each other.

In general, a main feature of the invention is that of providing the winding of the suspension ropes of the element to be translated in the spiral groove or rim of a pair of opposing pulleys linked to each other by means of a shaft rotatably supported on a bearing structure, said shaft being fixed to the end of a helical spring properly dimensioned and having its opposite end linked to a friction device that allows the spring to be loaded by means of the rotation of the pulleys that vertically move the element to be translated.

It is preferred to check the reaction stress of the spring means also with the passing of time, assuring it a minimum preloading and a corresponding reaction to the moment of torsion caused by the weight of the door to be vertically moved and by the changing of the radius of the spiral rim when rolling up the traction rope of the door to be moved.

Preferably the elastic means are spring means that are arranged co-axially with the shaft. It is also preferred that the opposite end of the spring means is free and independent with respect of the shaft.

According to an advantageous embodiment of the invention the friction disc is provided with an inclined head surface that is able to be rotated against a corresponding head surface of an opposing friction disc so as to exert an axial pressure on the friction disc, for blocking same against the support. Preferably in this at least one friction ring is provided so as to increase friction between the friction discs and the support. Furthermore it is preferred that the opposing friction disc is rotatable supported on a bush, said bush being supported on the shaft so as to be axially displaceable with respect to the support, and comprising a shoulder, one of the friction rings being arranged between the shoulder and the opposing friction disc. Moreover it is preferred that another friction ring is arranged between the shoulder and the support.

According to an advantageous embodiment of the invention the blocking of the friction disc against the support leads to blocking of the rotation also of the end of the spring means, whose opposite end is engaged in the rotation of the shaft put in rotation by the pulleys, every time the suspended element is vertically moved.

Preferably the blocking or loosening, in particular of the friction disc, by means of the rotation of the friction disc allows the adjustment of the torsion load required to be provided by the spring means to balance the weight of the suspended element, in any phase of the positioning of the suspended element along its vertical translation. Moreover suitably the spring means is twined around a drum so as to provide present a larger wider development surface for the spring means.

The present invention provides a sash sliding element for a piece of furniture or windows or doors that combines the maximum lightness of its non-structural part with its minimum bulk, still assuring a better quality of the vertical translation of the door or window.

Another advantage is that of achieving the desired balancing of the suspended element moving vertically, using a single compensating spring means that avoids any unbalancing with the passing of time.

Another advantage of the invention is that the construction, the assembly and the use of the balancing device for elements moving vertically on pieces of furniture or on windows or on doors are made easily to achieve.

BRIEF DESCRIPTION OF THE DRAWINGS

These and other advantages are in effect perfectly achieved with the present invention, as it can be inferred by the following description of one of its embodiments that is only indicative and not limitative, in combination with the drawings, in which.

In all drawings the same details are represented or are understood to be represented by the same reference numbers.

DETAILED DESCRIPTION OF THE EMBODIMENTS

Figure 1:
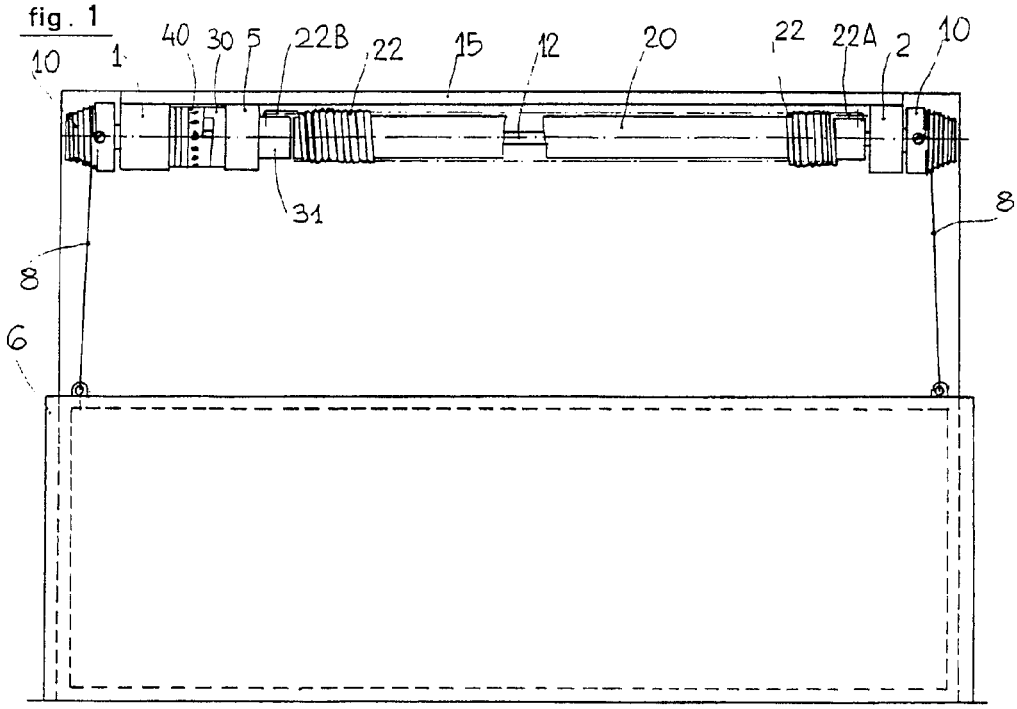
FIG. 1 illustrates a schematical front view of an vertically sliding element supported by the device of the present invention, represented in its lowered position for closing a port-hole of a frame.
Figure 2:
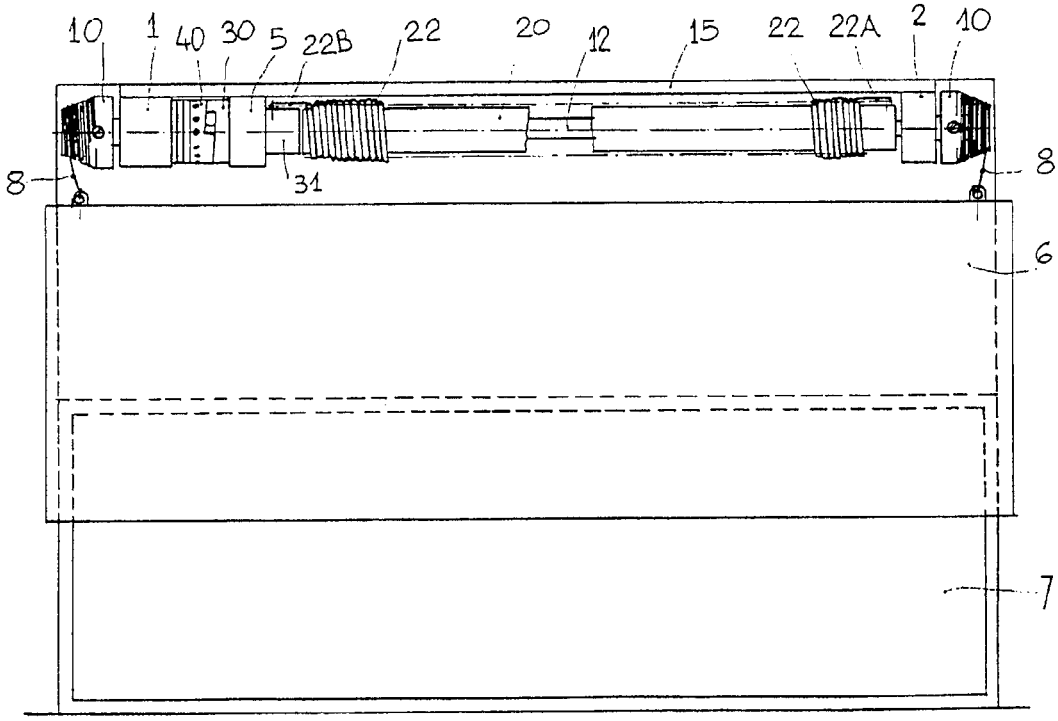
FIG. 2 illustrates a front view like the one represented in FIG. 1, but with the same sliding element partially lifted from the port-hole of the frame.

According to the embodiment proposed in the different figures of the drawings, a suspended sliding element 6, conventionally called hereinafter "door", is to be moved with respect to the port hole 7 of a frame, so as to make it partially or completely free or covered in its height, by means of ropes 8 each having an end linked to the upper end of the door 6 and the opposite ends linked to respective cone-shaped pulleys 10. The pulleys 10 are attached to a shaft 12 extending transverse to the moving direction of the door 6.

Both pulleys 10 comprise a cylindrical part 10A and a cone-shaped part 10B, a spiral rim 10C being provided on the latter part 10B.

On the cylindrical part 10A there is provided a radial threaded hole 10D that allows the passage of a grub screw 11, while a screw 13 allows the fixing of its respective rope 8, in a position near the beginning of the rim or descending thread 10C.

The grub screws 11 are screwed into the thread hole 10D to attach or block the pulleys 10 onto the ends of the shaft 12 and to make them integral with it. The term "integral" is used in the present case not in a sense that the integral elements are made of one part, but in a sense that they are rigidly attached to each other so that they can co-rotate or co-translate, etc.

Said shaft 12 is supported by a pair of supports 1 and 2 provided with bushings or bearings 3 and 4 or with other means with the same anti-rolling friction function.

A third support 5 is placed at a proper distance from the support 1 to cooperate with it during the blocking action of friction below better described.

Said supports 1-2 and 5 can be fixed on a base plate 15, by means of screws 9, 9*a*, said base plate 15 being linked to the upper cross brace of the frame 7, at which the door 6 is driven to translate vertically.

By means of a grub screw 21, a drum 20 is axially linked to the shaft 12, the length of said drum 20 being indicatively a little bit shorter than the distance between the inner side of the support 2 and the outer side of the support 5.

The drum 20 is linked to the end 22A of spring means 22 preferentially made of a spiral or helical spring and able to resist and react to the torsion load or stress exerted on the drum 20, when the pulley 10 makes it rotate by means of the shaft 12 and of the grub screw 21.

The opposite end 22B of the same spring means 22 is made integral by means of a grub screw 23 with a rod 31 of a friction disc 30, whose tilted head surface 32 is linked to the tilted surface 42 of an opposite friction disc 40.

Figure 4:
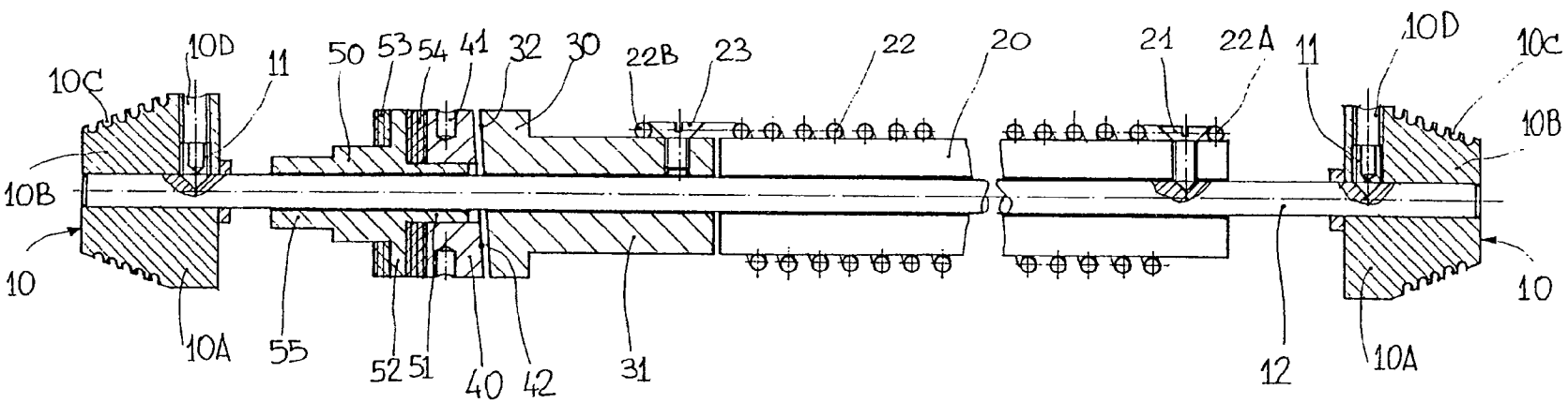
FIG. 4 illustrates an axial sectional view of the shaft and of the different parts that build the device, to be provided on the support of FIG. 3.
Figure 5:
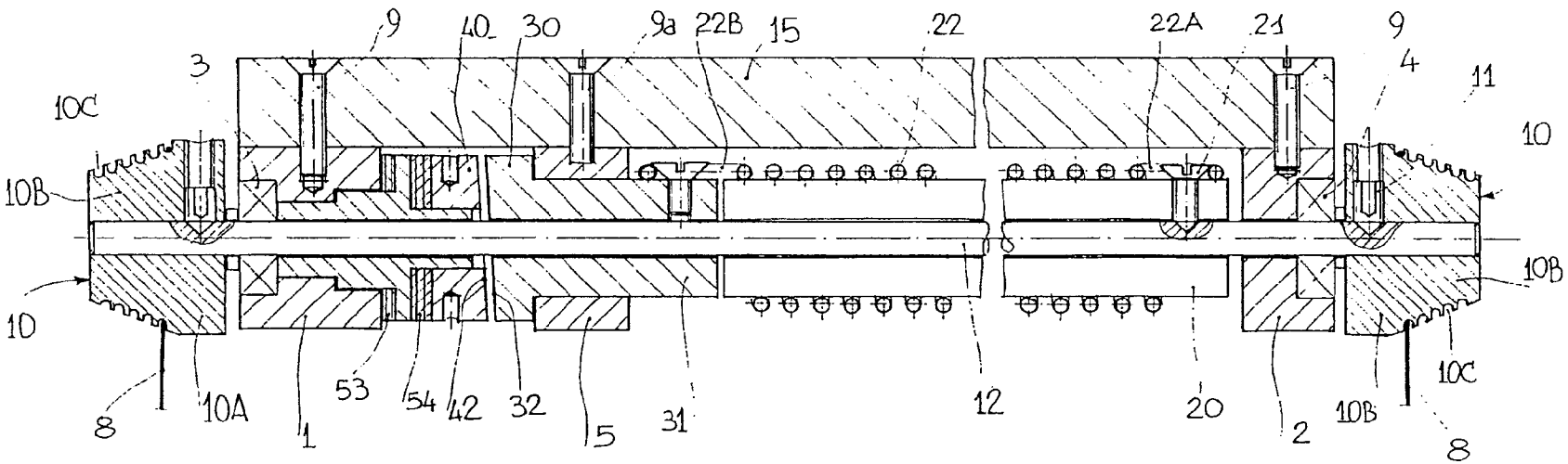
FIG. 5 illustrates an axial sectional view of the device of FIG. 4 applied on the support of FIG. 3, being, by way of example, represented with its spring means under minimum torsion and with the supporting ropes in the condition, in which they are when the door is let down, according to the drawing of FIG. 1.
Figure 6:
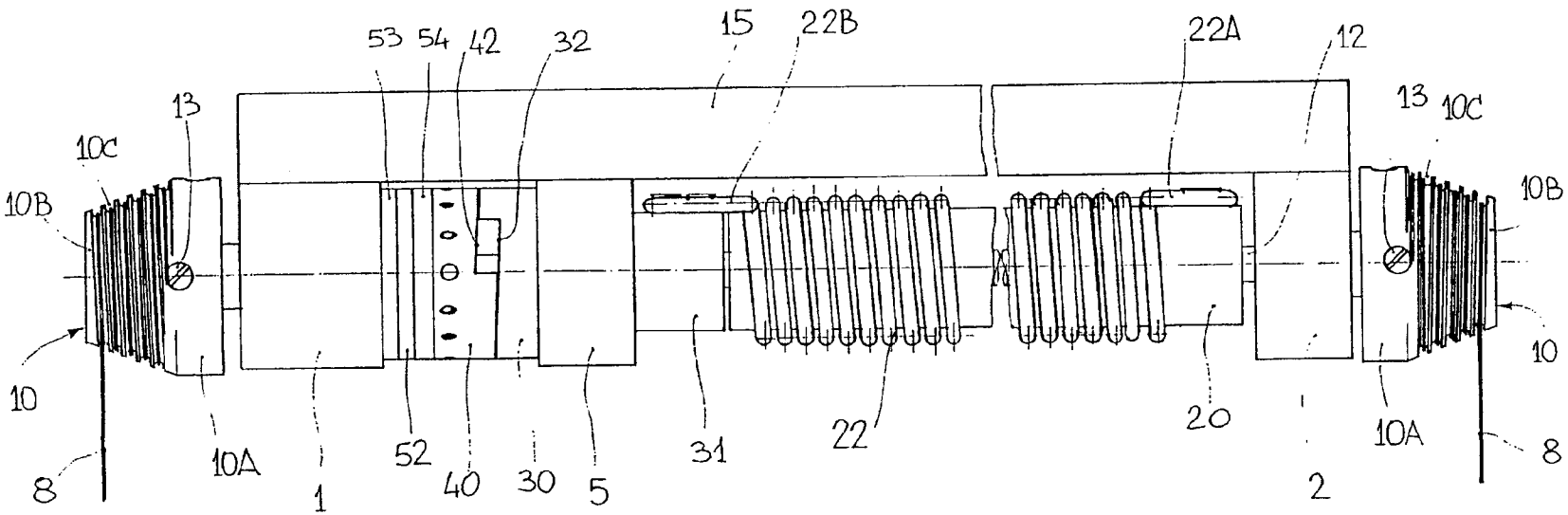
FIG. 6 illustrates a front view of the same device of FIG. 5, being, by way of example, represented with its spring means under maximum torsion and with its supporting ropes in the condition, in which they are when the door is lifted, according to the drawing of FIG. 2.

According to the proposed embodiment, in particular shown in FIGS. 4 and 5, the friction disc 40 is axially driven by a rod 51 of a bush 50 that is provided with a flange 52, against which rings 53, 54 made of antifriction material are arranged as supporting elements.

The same bush 50 is provided with a tang 55 guided by the support 1 so as to cooperate to the steering in the axial translation of the bush 50 and of the friction disc 40, even if it is not rotatably bound to the shaft 12.

To facilitate the sliding of the inclined plane 42 of the disc 40 on the inclined plane 32 of the disc 30, a series of blind holes 41 is provided on the outer surface of the disc 40 to insert therein an adjustment key or tool.

Figure 3:
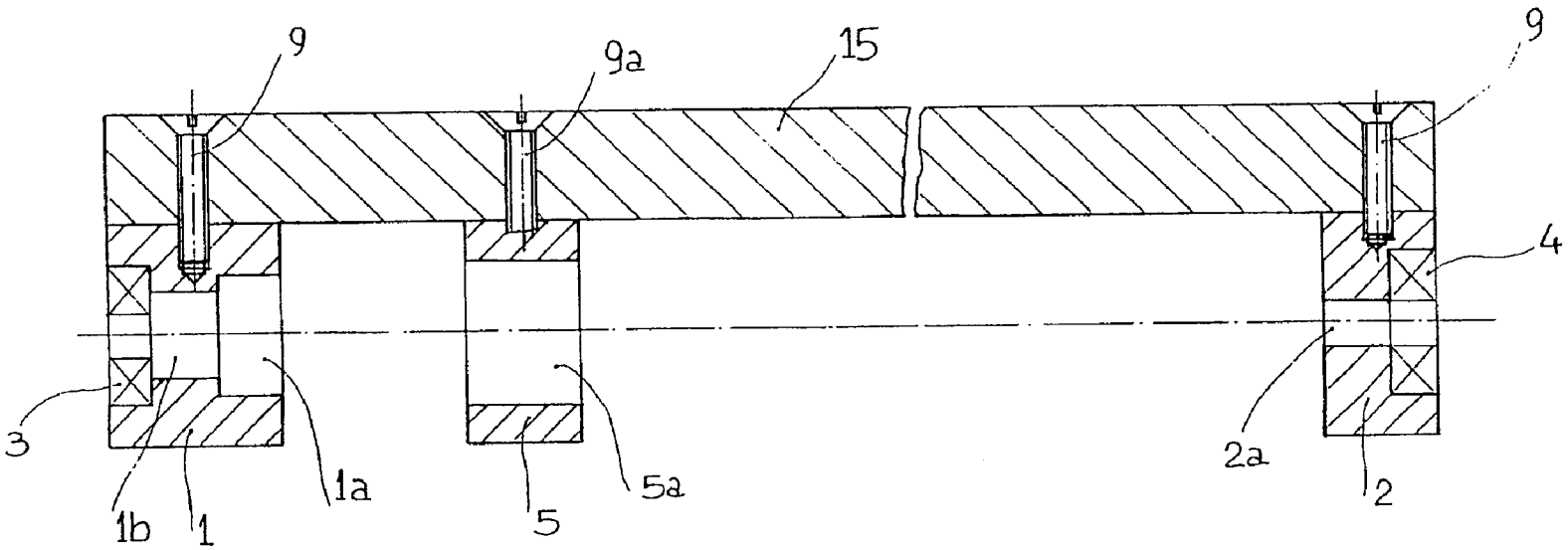
FIG. 3 illustrates an axial sectional view of a support of the device of the present invention, for the balancing and the support with movement of the door of FIGS. 1 and 2.

With reference to the FIG. 3, it can be inferred that the support 1 is provided with a hole for housing of the outer guide of the bushing 3 as well as with an opposing and co-axial hole 1*a* for housing of the bush 50 and with a preferentially reduced loop hole 1*b* for the housing the tang 55 of the bush 50.

From FIG. 3 it can be noticed that the opposing support 2 is provided, besides with a containment hole for the bushing 4, also with a co-axial hole 2*a* for the passage of the shaft 12, while the intermediate support 5 is provided with a loop hole (through hole) 5*a* for housing the rod 31 of the friction disc 30.

Having thus described the few parts compounding the present invention, their functioning is hereafter summarized also with reference to the specified advantages.

Following a predictable succession of phases, in relation with the width of the port hole to be covered with the vertically moving door 6, a base plate 15 having an adequate length is applied on the upper edge of the frame 7 or port hole itself, in order to drive the supporting ropes 8 of the door 6 itself, so that the pulleys 10 for the rolling up and the unrolling of the ropes 8 are indicatively aligned on the vertical line of the fixing points of the ropes 8 themselves with the edges of the door 6, so as to leave the ropes 8 on the outer sides of the respective supports 1 and 2.

According to a preferential assembling method, before making the inventive device work on the port hole and before connecting it to the door 6 to be moved, the different parts associated with the friction discs 30 and 40 have to be linked and said discs 30, 40 thus prepared have to be inserted into the respective seats of the supports 1 and 5. Then, the shaft 12 has to be applied and linked to the drum 20 with its helical spring 22 and finally said parts have to be linked to the shaft 12, that is inserted and arranged between the supports 1 and 2.

During the assembly of the inventive device to the frame 7 of the piece of furniture or door or window, in which a sash closing is wished to be applied, it is thus sufficient to link, apply and fix the pulleys 10 onto the above mentioned ends of the shaft 12 that project from the supports 1 and 2, for instance by means of said grub screws 11 that are screwed into the thread holes 10D, so as to press their tip into the shaft 12, in order to make the linking of the pulleys 10 with the shaft 12 stable.

Still before proceeding with the assembly of the invention device, the end 22A of the spiral spring 22 has to be linked to the drum 20, by means of the screw 21 that is turned into the shaft 12, blocking said drum 20 thereto, while the opposing end 22B is made integral with the rod 31 of the friction disc 30 by means of the screw 23 that does not stuck or touch the shaft 12, so that the disc 30 is rotationally independent from the rotation of the shaft 12.

In this phase or in any following moment of the assembly of the described parts, and anyway after having also stably positioned the support 5, the base plate 15 can be applied on the ceiling or upper part of the frame 7 to be vertically opened.

The fixing of the ends of the ropes 8 to the screws 13 of the pulleys 10 and of their opposite ends to fixing elements 6A and 6B of the upper edge of the door 6 allows the pulleys 10 to lift the door 6 thanks to their rotation, by means of the winding of the ropes 8 on the spiral rims 10C, according the winding criteria already claimed in the above mentioned patent that is intended to be improved.

The rotation of the pulleys 10 allows then to roll up the ropes 8 along the rim 10C, on the cone-shaped side 10B of each pulley 10, wherein the length or development of the rim 10C is pre-determined in relation to the length of the rolling up and unrolling travel that is predicted for the door 6 to which the inventive device is to be applied. Nevertheless, without an adjustment of the device by means of the friction discs 30 and 40, when the rotation force of the pulleys 10 ceases, the door 6 would immediately fall down, because the spring means 22 would not undergo any torsion.

In fact, according to the functioning details till now described, with the rotation of the pulleys 10, also the rotation of the drum 20 and of the helical spring 22 would normally occur. Further, since the side 22B of said spring 22 is linked to the rod 31 of the friction disc 30, this rotation would drag said disc 30, whose inclined plane 32 would drag the opposing inclined plane 42 of the friction disc 40 and consequentely the rotation of the bush 50 would start without the spring 22 meeting a fix point necessary for its balancing function.

According to the present invention, taking advantage of the principle of the inclined planes 32, 42 of the discs 30, 40, it is possible to make rotate the friction disc 40 also by means of an adjustment key to be inserted into the proper holes 41, so that its inclined surface 42 slides on the inclined surface 32 of the disc 30 with the consequent axial translation of the bush 50 and of the friction discs 53, 54 acting on the flange 52 of the bush 50.

With the translation of the above mentioned bush 50 a progressive compression of the friction discs 30 and 40 as well as of the friction means 52, 53, and 54 against the inner shoulders of the supports 1 and 5 takes place, until the disc 30 in particular is blocked against its support 5.

This expedient allows the blocking of the rod 31 of the same disc 30 during the preloading of the torsion spring 22.

As a matter of fact, continuing the explanation of the assembly phases as described above, after having blocked the rod 31 of the disc 30, to which the end 22B of the spring means 22 is already fixed, the pulleys 10 are made spin and so are the shaft 12 and the drum 20, onto which the opposing end 22A of the same spring mean 22 is linked, until the spring means 22 itself has accumulated the right torsion preloading. This is done before fixing the ends of the ropes 8 in the seats 13 of the pulleys 10.

Proceeding then with the rotation of the pulleys 10, the ropes 8 are gradually wound onto the respective spiral rims 10C with the consequent lifting of the door 6, while the spring means 22 continues its torsion, expressing a reaction force always balanced with the weight of the door 6.

Consequently, when suspending the rolling or unrolling force to the door 6 in any point of its vertical travel, a perfect equilibrium between the weight of the door 6 and the reaction of the spring means 22 is achieved, also thanks to the shape of the spiral rims 10C of the pulleys 10, according to what is described in the previously patent.

In this way the perfect balance of the door 6 to be moved vertically along the frame 7 is achieved, eliminating the heavy and bulky counter weights and the encumbering presence of the helical traction springs on the sides of the frame 7, simply by using a torsion spring means 22 to be placed co-axially to the rolling and unrolling pulleys 10 of the ropes 8 supporting the door 6, thus achieving a main advantage of the invention.

Practically, after the phase of assembling of the parts of the inventive device, the spring means 22 is preloaded and blocked, acting on the friction discs 30 and 40 according to what is described above, in order to minimize its assembly operations.

Nevertheless, if the weight or the length of the travels of the doors 6 are different from those theorically foreseen, this device allows the loosening of the friction discs 30 and 40 against the shoulders 1 and 5 by means of the adjustment key to be engaged on the holes 41 of the disc 40 so as to allow the rotation of the pulleys 10 and thereby increase or decrease of the torsion of the spring means 22 to assure in any case the perfect balancing between the weight and the travel of the door 6 and the sash weight reaction of the spring means 22.

Such an adjustment of the balance is possible also with the passing of time, at any time when an unbalancing occurs, for example because of an increase of the weight of the door 6 or because of the reduction of the reaction of the spring means 22, thereby accomplishing another of the specified advantages.

The constructive and assembling simplicity of the elements comprised in the illustrated device as well as its safety and stability correspond to the other advantages specified.

Of course, the constructive details described above are to be understood as purely indicative and not limitative, as already stated.

In fact it is possible, for example, to invert the position of the friction discs 30, 40 with respect to their supports 1 and 5, as well as to invert the position of the supports 1, 2 with respect to the ends of the shaft 12.

If the doors 6 are particularly long, two base plates 15 can be coupled to the same shaft 12 for a corresponding pair of extremity pulleys 10, with respective and opposing supports 1-2-5 and with respective and opposing spring means 22 to be adjusted by corresponding friction disc systems 30 and 40, each part being accomplished according to what is described above.

It is also possible to subdivide the frame 7 into two or more ports to be closed with a corresponding number of doors, which can be vertically moved thanks to two or more different devices like the one at issue, said devices being parallel to each other and placed in a single or in different positions.

Furthermore, it is possible to increase the resistance and solidity of the supports 1 and 5 against the axial thrust of the discs 30 and 40, linking the supports 1, 5 together with tie-rods, that block the supports 1, 5 against shoulders or intermediate distance pieces.

It is also possible to replace the helical spring 22 with any other elastic or torsion spring means having an equivalent reduced volume and the same reaction force. As well, it is possible to simultaneously provide for more than one co-axial spring means 22, provided they have an end 22A linked to the shaft 12 and an end 22B linked to the friction disc 30.

Finally, it is possible to provide a box structure that, by linking to the base plate 15, contains the device in length, leaving out only the pulleys 10 and providing a passage, through which the adjustment key can be inserted into the holes 41 of the disc 40.

These and other similar modifications or adjustements are in any way understood as belonging to the present invention to be protected.

In summary, a main feature of this invention is that of winding up the supporting ropes 8 of the element 6 to be translated in spiroid rims 10C of a pair of opposing pulleys 10, said pulleys 10 being integral with each other via to a shaft 12 that is rotatable on a bearing structure 1-2, said shaft 12 being concentric to a helical spring 22, that comprises one end 22A integral with said shaft 12, while the other end 22B is integral with the basis 31 of a friction disc 30, that can be blocked to its support 5 to block the other end 22B of the spring 22, whose opposite side is bound to turn with the shaft 12, in order to increase or decrease its torsion reaction with the changing of the movement of the pulleys 10, assuring in that way the balancing of the balanced translation of the element 6 on a frame 7 to be vertically covered or uncovered.

The invention claimed is:

1. A balancing device attached to a suspended element, comprising:

a shaft rotatably supported on a support;

a pair of opposing pulleys attached to the shaft to be rotatable therewith;

a pair of supporting ropes, one end of each of which being attached to the suspended element, and respective other ends being attached to the pulleys, wherein each of the pulleys comprises a spiral groove onto which respective of the ropes can be rolled for translating the suspended element, wherein the shaft is linked to an end of an elastic mechanism whose opposite end is attached to a friction disc, wherein the friction disc is rotatably supported on the support and is configured to be blocked against the support, to allow adjustment of a torsion load caused by simultaneous rotation of the pulleys and the shaft, and is provided with a head surface that is inclined with respect to an axis of the shaft and is configured to be rotated against a corresponding head surface of an opposing friction disc to exert an axial pressure on the friction disc, for blocking the friction disc against the support.

2. The device of claim 1, wherein the elastic mechanism comprises a spring arranged coaxially with the shaft.

3. The device of claim 2, wherein the opposite end of the spring is free and independent with respect to the shaft.

4. The device of claim 1, wherein at least one friction ring is provided to increase friction between the friction discs and the support.

5. The device of claim 4, wherein the opposing friction disc is rotatably supported on a bush, the bush being supported on the shaft to be axially displaceable with respect to the support, and comprising a shoulder, one of the friction rings being arranged between the shoulder and the opposing friction disc.

6. The device of claim 5, wherein another friction ring is arranged between the shoulder and the support.

7. The device of claim 1, wherein the blocking of the friction disc against the support leads also to blocking of the rotation of the end of the elastic mechanism, whose opposite end is engaged in the rotation of the shaft put in rotation by the pulleys, every time the suspended element is vertically moved.

8. The device of claim 1, wherein the blocking of the friction disc by rotation of the friction disc allows the adjustment of the torsion load required to be provided by the elastic mechanism to balance a weight of the suspended element, in any phase of positioning of the suspended element along its vertical translation.

9. The device of claim 1, wherein the elastic mechanism is twined around a drum to provide a larger and wider development surface for the elastic mechanism.

10. A balancing device for a suspended element, comprising:

a shaft rotatably supported on a support;

a pair of opposing pulleys attached to the shaft to be rotatable therewith, wherein each of the pulleys comprises a spiral groove onto which respective rope of a pair of supporting ropes can be attached and rolled for translating the suspended element;

wherein the shaft is linked to an end of an elastic mechanism whose opposite end is attached to a friction disc, wherein the friction disc is rotatably supported on the support and is configured to be blocked against the support, to allow adjustment of a torsion load caused by simultaneous rotation of the pulleys and the shaft, and is provided with a head surface that is inclined with respect to an axis of the shaft and is configured to be rotated against a corresponding head surface of an opposing friction disc to exert an axial pressure on the friction disc, for blocking the friction disc against the support.

11. The device of claim 10, wherein each of the pulleys comprises a spiral groove onto which respective rope of a pair of supporting ropes can be rolled for translating the suspended element, one end of each of the ropes being attachable to the suspended element, and respective other ends being attachable to the pulleys.

12. The device of claim 10, wherein the elastic mechanism comprises a spring arranged coaxially with the shaft.

13. The device of claim 12, wherein the opposite end of the spring is free and independent with respect to the shaft.

14. The device of claim 10, wherein at least one friction ring is provided to increase friction between the friction discs and the support.

15. The device of claim 14, wherein the opposing friction disc is rotatably supported on a bush, the bush being supported on the shaft to be axially displaceable with respect to the support, and comprising a shoulder, one of the friction rings being arranged between the shoulder and the opposing friction disc.

16. The device of claim 15, wherein another friction ring is arranged between the shoulder and the support.

17. The device of claim 10, wherein the blocking of the friction disc against the support leads also to blocking of the rotation of the end of the elastic mechanism, whose opposite end is engaged in the rotation of the shaft put in rotation by the pulleys, every time the pulleys are put in rotation.

18. The device of claim 10, wherein the elastic mechanism is twined around a drum to provide a larger and wider development surface for the elastic mechanism.

* * * * *